United States Patent [19]

Marshall

[11] Patent Number: 4,505,814

[45] Date of Patent: Mar. 19, 1985

[54] ADJUSTABLY EXTENSIBLE ROOF DRAIN RECEPTACLE

[75] Inventor: Marshall W. Marshall, Tyler, Tex.

[73] Assignee: Tyler Pipe, North Swan, Tex.

[21] Appl. No.: 486,072

[22] Filed: Apr. 18, 1983

[51] Int. Cl.[3] ..... E03F 1/00

[52] U.S. Cl. ..... 210/166; 210/460; 210/463; 4/286; 4/288; 404/26; 52/20

[58] Field of Search ..... 210/163, 164, 165, 166, 210/460, 461, 462, 463, 459; 4/286, 288, 293; 52/126.2, 20, 21, 11-16; 285/3, 4, 42, 56; 404/26

[56] References Cited

U.S. PATENT DOCUMENTS

| | | | |
|---|---|---|---|
| 599,441 | 2/1898 | Dorr | 404/26 |
| 2,672,205 | 3/1954 | McDonald | 210/163 |
| 2,783,852 | 3/1957 | Sisk | 210/165 |
| 2,881,921 | 4/1959 | Baker et al. | 210/166 |
| 3,420,552 | 1/1969 | Mork | 4/288 |
| 3,447,329 | 6/1969 | Emberson | 61/63 |
| 3,893,919 | 7/1975 | Flegel et al. | 210/166 |
| 3,909,412 | 9/1975 | Patry | 210/460 |
| 3,921,661 | 11/1975 | Emberson | 285/3 |
| 4,092,745 | 6/1978 | Oropallo | 4/288 |
| 4,197,031 | 4/1980 | Hild | 210/163 |
| 4,281,944 | 8/1981 | Bowman | 210/163 |

FOREIGN PATENT DOCUMENTS

| | | | |
|---|---|---|---|
| 728991 | 3/1966 | Canada | 182/10 |

OTHER PUBLICATIONS

Wade Gasket Joint Specification Drainage Products Tyler Pipe, copyright 1982, p. 18.

Roof drains, Josam Manufacturing Co. copyright 1982, p. 5.

*Primary Examiner*—Richard V. Fisher

*Assistant Examiner*—Wanda L. Millard

*Attorney, Agent, or Firm*—Herbert E. Haynes, Jr.

[57] ABSTRACT

A roof drain receptacle for mounting on the roof deck of a roofing structure and including an upwardly opening drain body with an externally disposed apparatus for adjustably extending and supporting the drain body so that its open upper end is in the proper drain water receiving position relative to the top surface of the roofing structure.

20 Claims, 5 Drawing Figures

ADJUSTABLY EXTENSIBLE ROOF DRAIN RECEPTACLE

BACKGROUND OF THE INVENTION

1. Field of the Invention

This invention relates generally to drainage receptacles and more particularly to an adjustable highly reliable drain receptacle for use in roof drainage systems.

2. Description of the Prior Art

As is well known in the art, successful roof drain installations are directly attributable to various factors which require careful consideration. Among such factors is the roof drain receptacle itself, which should be a highly reliable structure that is ideally capable of being adjusted or otherwise adapted to suit various roofing conditions, such as deck type, thickness, and the like, and does not require that an installer have a high degree of installation expertise.

Most prior art roof drain receptacles include a drain body having an annular flange which extends laterally from the upper end thereof and is in bearing engagement with the upper surface of the roof deck and is usually clampingly attached to the roof deck by means of an underdeck clamp to insure that the roof drain receptacle is properly supported and positively secured. The drain body has an upwardly opening sump for receiving water from the surface of the roof and is provided with a drain outlet which is connected to the leader pipe of the drain system.

When the roofing materials, which are supported on the roof deck, such as insulation, are less than a maximum thickness, usually about two inches, or the materials are tapered toward the drain to provide such a thickness proximate the drain, a flashing ring is attached to the upper end of the drain body and coacts therewith to sealingly attach the drain receptacle to a suitable flashing element or roofing membrane. A dome structure having a slot or other openings formed therein is carried atop the flashing ring to allow the free inflow of water and yet restrict the passage of solid materials, such as leaves, which could cause drain system blockage. This basic type of roof drain receptacle is highly reliable and simple to install. However, its use is limited to roof structures having a relatively small thickness of roofing materials proximate the roof drain receptacle as mentioned above.

Whenever the roofing materials proximate the roof drain receptacle installation location exceeds the predetermined maximum, some form of extension element must be used to raise the top of the roof drain receptacle up to the level of the top surface of the roof.

In some prior art structures, a fixed height extension collar is interposed between the upper end of the drain body and the flashing ring. In such cases, the upper end of the extension collar cooperates with the flashing ring for sealingly attaching the drain receptacle to the flashing element or roof membrane and the lower end of the extension collar is sealed by means of a suitable sealant or gasket to the upper end of the drain body. The use of such a fixed height extension collar provides no means for installation adjustments which means that the roof drain receptacle simply cannot be used unless the proper fixed height extension collar is ordered and supplied with the balance of the roof drain receptacle components. In addition to this, whenever the use of a sealant or gasket is required in the roof drain receptacle itself, installation time is increased, the integrity of the drain receptacle is dependent on the skills of the installer and the materials used in forming the seal, and seal failures can occur due to vibrations, expansion and contraction, and the like, as well as seal deterioration resulting from environmental effects.

In other prior art structures, the problems associated with the hereinbefore described fixed height extension collars are overcome, or at least reduced, by providing an adjustable extension collar which is externally threaded for adjustable threaded attachment to internal threads provided in the drain body per se, or by a special support ring mounted thereon. In a variation of the adjustable extension collar, threaded rods are employed to interconnect and vary the height of the adjustable extension collar relative to the drain body. In any case, the requirement for forming an internal seal between the adjustable extension collar and the drain body, is as much of a problem as it is in the fixed height extension structures described above.

Therefore, a need exists for a new and improved adjustably extensible roof drain receptacle which overcomes some of the problems and shortcomings of the prior art.

SUMMARY OF THE INVENTION

In accordance with the present invention, a new and improved adjustably extensible roof drain receptacle is disclosed as including a drain body, flashing ring, underdeck clamp, and having adjustable extension means in accordance with the present invention for attachment to the upper surface of the roof deck for supporting the drain body at adjustably variable heights above the roof deck. By adjusting the vertical disposition of the roof drain body to suit the thickness of the roofing insulation or other materials, rather than adding an extension collar thereto as in the prior art structures, the need for providing a sealing gasket or otherwise forming a seal within the roof drain receptacle is eliminated.

The adjustable extension means is a two element structure including a deck flange for attachment to the upper surface of the roof deck and an adjustable collar which is attached to the underside of the upper annular flange of the drain body. The deck flange and the adjustable collar are provided with cooperating elements of an extensibly adjustable interconnection means by which the adjustable collar is attached to the deck flange and is vertically adjustable relative thereto to provide the roof drain receptacle of the present invention with a full range of the adjustments needed for mounting it in virtually any roofing structure.

Accordingly, it is an object of the present invention to provide a new and improved roof drain receptacle which is highly reliable and simple to install.

Another object of the present invention is to provide a new and improved roof drain receptacle which is adjustably extensible to suit various thicknesses of roofing insulation or other materials.

Another object of the present invention is to provide a new and improved adjustably extensible roof drain receptacle of the above described character which eliminates the prior art requirement of providing a sealing gasket or otherwise forming a seal in the drain body of such vertically adjustable roof drain receptacles.

Another object of the present invention is to provide a new and improved adjustably extensible roof drain structure including a drain body having an annular laterally extending flange and an adjustable extension means which circumscribes the drain body and supports the flange thereof at adjustably variable heights above the roof deck.

Another object of the present invention is to provide a new and useful adjustably extensible roof drain receptacle of the above described character, wherein the adjustable extension means includes a deck flange for attachment to the upper surface of a roof deck and an adjustable collar for attachment to the drain body.

Still another object of the present invention is to provide a new and improved adjustably extensible roof drain receptacle of the above described type, wherein the deck flange and the adjustable collar are provided with cooperating elements of an adjustably extensible interconnection to provide the means for adjusting the roof drain receptacle to suit various thicknesses of roofing materials.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
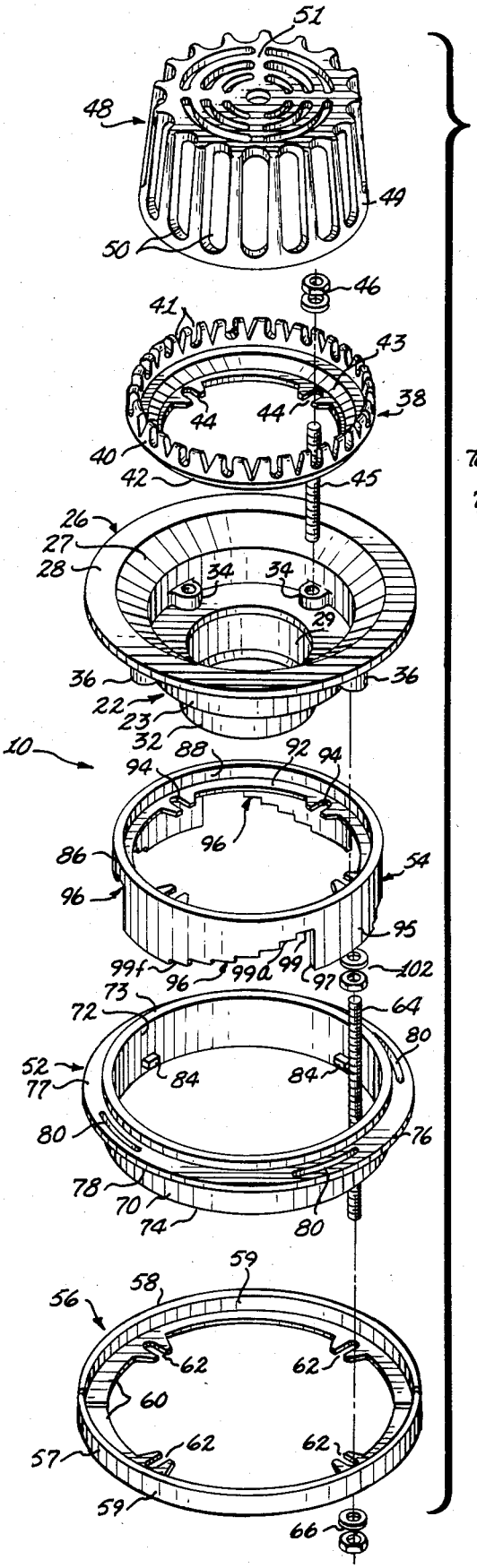
FIG. 1 is an exploded perspective view of the adjustably extensible roof drain receptacle of the present invention illustrating the various features thereof.

Referring more particularly to the drawings, FIG. 1 shows the adjustably extensible roof drain receptacle of the present invention which is indicated in its entirety by the reference numeral 10.

Before proceeding with the detailed description of the roof drain receptacle 10, it is felt that a general discussion of roof structures and configurations will aid in a complete understanding of the present invention. Therefore, reference is made to FIGS. 4 and 5 wherein a typical roof structure 12 is illustrated.

The roof 12 is shown as having a substrate 14, which is referred to in the art as a roof deck. Many types of roof decks are used with the most common types being preformed steel, precast-prestressed concrete, structural cement slab or plank, poured reinforced concrete, insulating concrete, gypsom concrete and wood. The roof deck 14 is the supporting structural element of the roof 12 and may vary considerably in thickness from one building to another.

Figure 4:
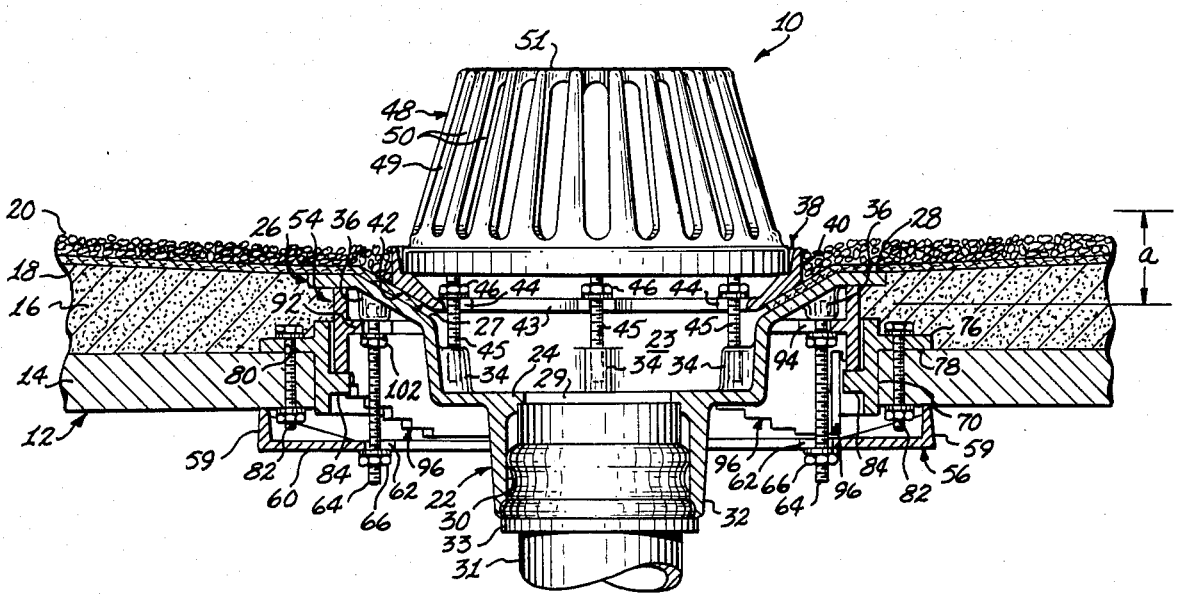
FIG. 4 is a vertical sectional view taken through the roof drain receptacle of the present invention which is assembled and installed in a typical roof structure and which has the adjustable extension means assembled in a manner to provide a low adjustment range.
Figure 5:
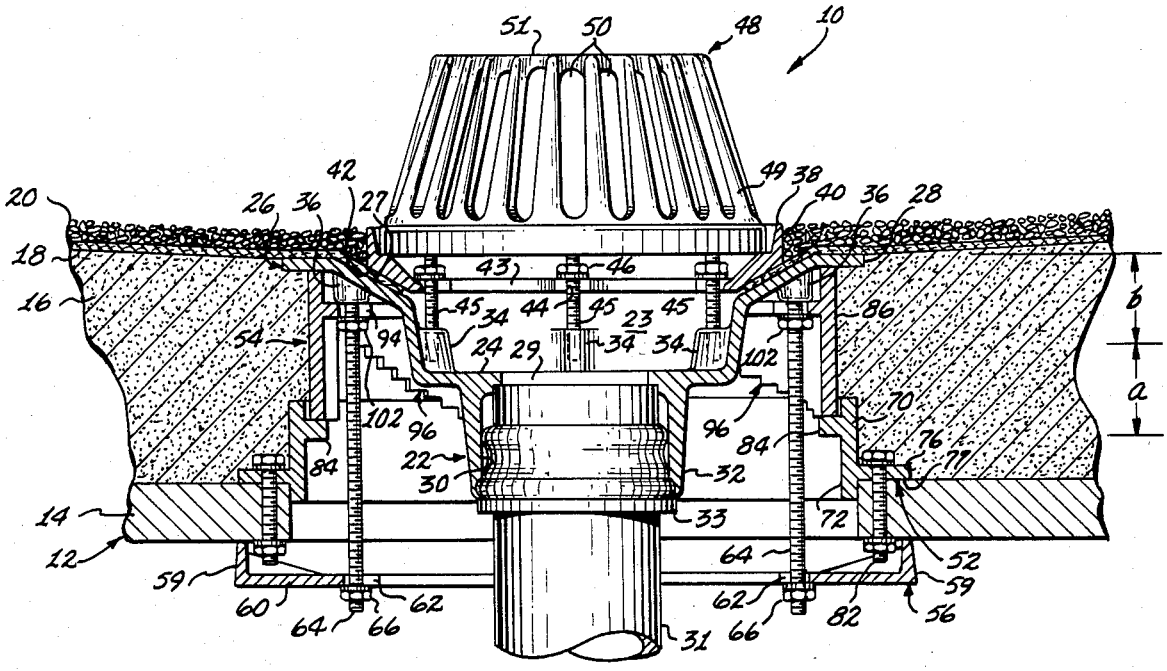
FIG. 5 is a view similar to FIG. 4 which has the adjustable extension means assembled in a manner to provide a relatively higher adjustment range.

In most roof structures, it is a common practice to overlay the roof deck 14 with suitable roofing materials 16, such as insulation which may vary in thickness as does the roof deck 14, and to overlay the roofing materials with a membrane 18 which is normally of felt. A top coating layer 20, such as of gravel, is provided on the membrane 18. It will be noted that the roofing materials 16, membrane 18, and the top coating 20 are shown in FIGS. 4 and 5 as sloping toward the roof drain receptacle. The National Roofing Contractors Association recommends that the roof be so tapered proximate the drain, to facilitate water flow into the drain.

The adjustably extensible roof drain receptacle 10, as seen best in FIG. 1, includes a drain body 22 having a substantially cylindrical sump portion 23 which has a bottom closing floor wall 24 and is open at its upper end. An annular flange 26 circumscribes the open upper end of the sump 23 and the flange 26 is defined by an angularly disposed concentric inner portion 27 and an outer concentric peripheral portion 28, which lies in a plane which is normal with respect to the axis of the drain body 22. A central opening 29, as seen best in FIGS. 4 and 5, is formed through the floor wall 24 of the sump 23, so as to open into a bore 30 of an axially depending coupling boss 32 provided on the drain body 22. The coupling boss 32 may be of any suitable configuration for making a leak-proof connection with a drain pipe 31, with such a connection being made in the illustrated example by an elastomeric seal 33 which is frictionally interposed between the periphery of the drain pipe 31 and the bore 30 of the coupling boss 32. As will be hereinafter described in detail, the drain body 22 is further provided with a plurality of upwardly opening internally threaded bosses 34 within the sump portion 33 thereof and a plurality of downwardly opening internally threaded bosses 36 integrally depending from the downwardly facing surface of the annular flange 26.

The upwardly opening plurality of internally threaded bosses 34 of the drain body 22 are employed for attaching a flashing ring 38 to the drain body. The flashing ring 38 has a substantially ring-shaped body which includes an endless upstanding peripheral wall 40 which is notched as at 41 in equally spaced radial increments. A downwardly angularly and inwardly sloping endless wall 42 is integrally formed on the lower end of the peripheral wall 40 and an endless horizontally disposed ledge 43 extends inwardly from the lower edge of the sloping wall 42. A plurality of bifurcated extensions, each of which defines an inwardly opening notch 44, are provided on the horizontal ledge 43, so as to extend inwardly therefrom.

When the roof drain receptacle 10 is to be installed in the roof structure 12, a hole is cut through the membrane 18, materials 16, and the deck 14, for receiving the receptacles. When mounting the receptacle 10 in such a cut hole, the circular edge of the membrane 18 which circumscribes the cut hole, is interposed between the angular inner portion 27 of the annular flange 26 of the drain body 22, and the angularly disposed wall 42 of the flashing ring 38. A plurality of threaded rods 45 are mounted in the upwardly opening threaded bosses 34 of the drain body 22 so as to pass upwardly through the aligned notches 44 defined by the bifurcated extensions of the flashing ring 38. Suitable nut/washer assemblies 46 are mounted on the upper ends of the threaded rods 45 above the bifurcated extensions, and are threadingly moved into bearing engagement therewith to clampingly seal the cut circular edge of the membrane 18 between the flashing ring 38 and the drain body 22.

In addition to the above membrane clamping function, the flashing ring 38 provides a seat for supporting a strainer dome 48. The strainer dome is of substantially frusto-conical configuration with an endless sidewall 49 which is slotted as at 50, a slotted, or otherwise perforated top wall 51, and is open on its lower end. The dome 48 cooperates with the notched upstanding peripheral wall 40 of the flashing ring 38, to prevent entry of foreign matter into the drainage receptacle 10 while admitting a substantially free flow of water thereinto.

The roof drain receptacle 10 is provided with an adjustable extension means of the present invention, which includes an invertible deck flange 52 and an adjustable collar 54, which supportingly mount the drain body 22, and thus the flashing ring 38 and strainer dome 48, on the upwardly facing surface of the roof deck 14 as will hereinafter be described in detail. The adjustable extension means allows adjustments to be made in the vertical disposition the drain body 22, flashing ring 38, and strainer dome 48 relative to the roof deck 14, to suit thickness dimensions of the roofing materials 16, and therefore bring the drain receptacle 10 up to grade, i.e., proper drain water receiving position.

With the drain body 22, flashing ring 38, and strainer dome 48 supportingly carried on the upper surface of the roof deck 14, an underdeck clamp 56 is preferably provided to securely clamp the roof drain receptacle 10 to the roof deck 14. The underdeck clamp 56 includes a pair of semicircular elements 57 and 58, which cooperatively form a ring-shaped body having an upstanding peripheral flange 59 with a horizontally disposed ledge 60 extending inwardly from the lower end of the flange. Each of the semicircular elements 57 and 58 are provided with a pair of bifurcated extensions which extend inwardly from the annular ledge 60 with each bifurcated extension defining an inwardly opening notch 62.

An elongated threaded rod 64 is threadingly carried in each of the downwardly opening bosses 36 of the drain body 22, so as to extend downwardly therefrom through the aligned notches 62 defined by the bifurcated extensions of the underdeck clamp 56, with a nut/washer fastener assembly 66 being mounted on the depending end of each of the rods 64 below their respective bifurcated extensions. Threaded movement of the fastener assemblies 66 in the upward direction will bring them into bearing engagement with the bifurcated extensions, and thereby bring the upper rim of the upstanding peripheral flange 59 of the underdeck clamp into clamping engagement with the downwardly facing surface of the roof deck 14.

Figure 2:
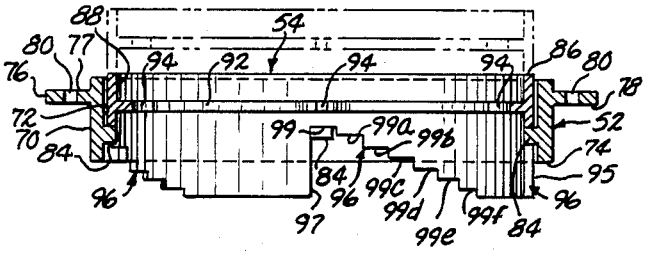
FIG. 2 is a vertical sectional view taken through the preferred embodiment of the means for vertically adjusting the roof drain receptacle with some of the components of the receptacle itself being omitted to clearly show the features of the adjustable extension means.

As seen best in FIGS. 1 and 2, the invertible deck flange 52 of the adjustable extension means of the present invention includes a cylindrical body 70 which defines an axial bore 72 which is open on its opposite ends 73 and 74. An annular ledge 76 extends laterally and integrally from the cylindrical body 70 and is disposed proximate the open end 73 thereof. The annular ledge 76 defines a surface 77 which faces the open end 73 of the cylindrical body 70 and an opposite surface 78 which faces the other open end 74 of the body 70. The annular ledge 76 is provided with a plurality of elongated arcuate openings 80 formed therethrough by which the deck flange 52 is mounted on the roof deck 14 such as with the nut/bolt fastener assemblies 82 shown in FIGS. 4 and 5.

As hereinbefore mentioned, the deck flange 52 is an invertible, or reversible structure, which may be selectively mounted, as needed, in a first position shown in FIG. 4 or in an inverted second position shown in FIG. 5, to provide a lower adjustment range a or an upper adjustment range b.

In the first mounted position of the deck flange 52, the surface 78 of the annular ledge 76 is in engagement with the upwardly facing surface of the roof deck 14, so that the open end 73 of the cylindrical body 70 faces upwardly, and the opposite open end 74 faces downwardly. Since the annular flange 76 is proximate the open end 73, the largest portion of the cylindrical body 70 extends downwardly through the cut hole provided in the roof deck. It follows then that when the deck flange 52 in inverted so that the opposite surface 77 of the annular flange 52 is in bearing engagement with the upper surface of the roof deck as shown in FIG. 5, the largest portion of the cylindrical body 70 will extend upwardly from the roof deck.

A plurality of radial lugs 84 are provided on the cylindrical body 70 so as to extend inwardly therefrom into the bore 72 thereof. It will be noted that the radial lugs 84 are positioned so as to be proximate the open end 74 of the cylindrical body. The reason for such positioning of the lugs 84 and the purpose of the lugs will hereinafter be described in detail.

The adjustable collar 54, which in conjunction with the above described deck flange 52, forms the adjustable extension means of the present invention, is seen best in FIGS. 1 and 2 to include a substantially cylindrical housing 86. The housing 86 has an outside diameter which allows it to be axially and rotatably moved in the bore 72 of the deck flange 52, with the housing 86 being coaxial and in close proximity with the sidewall of the housing 70 which defines the bore 72.

The housing 86 of the adjustable collar 54 defines a bore 88 which is open at its top and bottom ends, and has an annular ledge 92 extending radially inwardly into the bore 88 thereof. The annular ledge 92 is provided with a plurality of bifurcated extensions which extend radially from the ledge into the bore 88 with each of those bifurcated extensions defining an inwardly opening notch 94. The annular ledge 92 is disposed proximate the open top end of the housing 86, so that the housing may be defined as having a relatively short upper cylindrical segment and a relatively larger depending skirt 95.

The depending skirt segment 95 of the housing 86 is provided with a plurality of what may be defined as stair-step notch means 96, with there being a total of four identical notch means in the illustrated example. As best seen in FIG. 2, each of the stair-step notch means 96 are defined by an end surface 97 which extends upwardly from the depending rim of the housing 86 into proximity with the annular ledge 92, and the upper terminal end of that surface 97 opens onto a downwardly facing bearing surface 99 which extends substantially laterally therefrom. The bearing surface 99 is the first of a series of such bearing surfaces, which are identified as 99, **99*a* through 99*f***, and which extend laterally and are downwardly progressive in a stair-step configuration.

With the adjustable collar 54 coaxially disposed in the bore 72 of the invertible deck flange 52, by rotating and axially moving the collar 54 in the bore 72 any one of the series of bearing surfaces 99–**99*f* may be selectively brought into resting bearing engagement with the radial lugs 84 provided in the bore 72 of the deck flange 52. When the bearing surfaces 99 of the stair-step notch means 96 are in resting engagement with the radial lugs 84, the adjustable collar 54 is in the axially retracted position shown in solid lines in FIG. 2. By lifting and rotating the adjustable collar 54 so as to bring the bearing surfaces 99f into resting engagement with the radial lugs 84 of the deck flange 52**, the collar will be moved to its axially extended position shown in dashed lines in that same figure.

Therefore, the above described deck flange 52 and the adjustable collar 54 provide the preferred embodiment of the adjustable extension means of the present invention, and the radial lugs 84 and the stair-step notches 96 form what may be defined as cooperating elements of an extensibly adjustable interconnection means.

As shown in FIGS. 4 and 5, the elongated threaded rods 64 which depend from the bosses 36 of the drain body 22, and are used to attach the underdeck clamp 56 are also used to attach the adjustable collar 54 to the underside of the flange 26 of the drain body 22. The rods 64 depend from the bosses 36 and pass through the notches 94 provided by the bifurcated extensions of the adjustable collar 54. Nut/washer fastener assemblies 102 are carried on the threaded rods 64 below the bifurcated extensions of the adjustable collar 54 and firmly attach the collar to the underside of the flange of the drain body.

With the invertible deck flange 52 attached to the roof deck in the manner hereinbefore described and as shown in FIG. 4, the adjustable collar 54 attached to the drain body, lifting and rotational positioning of the valve body 22, will extensibly adjust the vertical position of the valve body by means of the hereinbefore described interaction of the adjustable extension means of the present invention. It will be apparent that such adjustments are made prior to fixedly attaching the underdeck clamp 56 to the elongated threaded rods. With the deck flange 52 mounted in the manner shown in FIG. 4, the range of vertical adjustment provided is indicated by the dimension arrow as identified by the reference character a.

Should the upper end of the drain body 22 need to be raised even further than the upper limit of the lower adjustment range a, the deck flange 52 may be inverted, as shown in FIG. 5, so that the radial lugs 84 of the flange are relocated to a position above the roof deck 14. When in such a position, the drain body 22 is vertically extensible in an elevated adjustment range indicated in FIG. 5 and identified by the reference character b.

Figure 3:
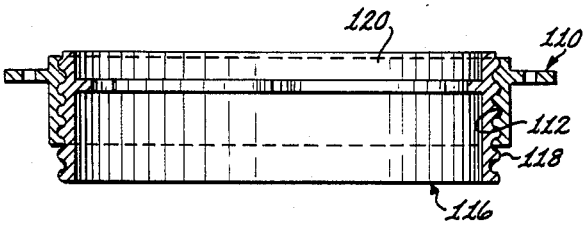
FIG. 3 is a view similar to FIG. 2 but showing a second embodiment of the adjustable extension means which may be used in the roof drain receptacle of the present invention.

Referring now to FIG. 3, wherein a second embodiment of the adjustable extension means of the present invention is illustrated. In this second embodiment, the invertible deck flange 110 is provided with internal threads 112 in its bore, and is otherwise similar to the hereinbefore described deck flange 52. Likewise, the adjustable collar 116 is similar to the above described collar 54, but has external threads 118 on its cylindrical housing 120. It will be evident from the above description that the internal threads 112 of the deck flange 110 and the external threads 118 of the adjustable collar 116 form cooperating elements of an extensibly adjustable interconnection means, and therefore are the functional equivalent of the hereinbefore described radial lugs 84 and the stair-step notches 96.

While the principles of the invention have now been made clear in illustrated embodiments, there will be immediately obvious to those skilled in the art, many modification of structure, arrangements, proportions, the elements, materials, and components used in the practice of the invention, and otherwise, which are particularly adapted for specific environments and operation requirements without departing from those priniciples.

For example, although the hereinbefore described embodiments of the present invention all disclose the adjustable extension means as being connected to the drain body proximate the annular flange thereof, it will be appreciated that the adjustable extension means could be otherwise attached to the drain body at various other locations on the periphery thereof. To illustrate this, the periphery of the sump portion could be formed with suitable brackets (not shown) or other means on its periphery, such as proximate its lower end, to which the hereinbefore described adjustable extension means is attachable.

The appended claims are therefore intended to cover and embrace any such modifications within the limits only of the true spirit and scope of the invention.

What I claim is:

1. In a combination of a roof structure with an adjustably extensible roof drain receptacle comprising:

(a) a roof structure having means defining an opening, said roof structure including a roof deck having an upper surface with roofing materials thereon to provide said roof structure with an upper surface;

(b) a drain pipe substantially coaxial with the opening of said roof structure and extending downwardly therefrom;

(c) a one piece drain body in the opening of said roof structure and having an open top for receiving water to be drained from the upper surface of said roof structure, said drain body having a bottom outlet directly connected in a leakproof manner to said drain pipe; and (d) extension means disposed about said drain body and attached to the upper surface of the roof deck of said roof structure and to the periphery of said drain body for supportingly mounting said drain body in the opening of said roof structure, said extension means being vertically adjustably extensible to position the open top of said drain body at a proper water receiving position relative to the upper surface of said roof structure.

2. The combination of claim 1 wherein said extension means comprises:

(a) a deck flange mounted on the upper surface of the roof deck of said roof structure so as to be substantially coaxial with the opening formed therethrough; and (b) an adjustable collar supportingly attached to the periphery of said drain body, said adjustable collar being connected to and axially extensible relative to said deck flange.

3. In a combination of a roof structure with an adjustably extensible roof drain receptacle comprising:

(a) a roof structure having means defining an opening and including a roof deck having an upper surface with roofing materials thereon to provide said roof structure with an upper surface;

(b) a drain pipe substantially coaxial with the opening of said roof structure and extending downwardly therefrom;

(c) a one piece drain body in the opening of said roof structure and having an open upper end for receiving water to be drained from the upper surface of said roof structure, said drain body having a bottom outlet sealingly connected directly to said drain pipe, said drain body having a flange which extends substantially laterally therefrom with said flange having a downwardly facing surface; and (d) adjustable extension means disposed about said drain body and mounted between the upwardly facing surface of the roof deck of said roof structure and the downwardly facing surface of said flange of said drain body to mount said drain body in the opening of said roof structure, said adjustable extension means being adjustable for positioning the open upper end of said drain body at adjustably selectable distances above the roof deck in a proper water receiving relationship with the upper surface of said roof structure.

4. The combination of claim 3 wherein said adjustable extension means is selectably mountable between the roof deck of said roof structure and said flange of said drain body in a first position to provide a relatively low range of adjustably selectable distances and a second position to provide a relatively higher second range of adjustably selectable distances.

5. The combination of claim 3 wherein said adjustable extension means comprises:

(a) a deck flange mounted on the upper surface of the roof deck of said roof structure in a substantially coaxial position relative to the opening formed therethrough;

(b) an adjustable collar connected to the downwardly facing surface of said flange of said drain body; and (c) cooperating elements of an adjustably extensible interconnection means on said deck flange and on said adjustable collar for interconnecting said deck flange and said adjustable collar in selectively extensible positions relative to each other.

6. The combination of claim 3 wherein said adjustable extension means comprises:

(a) a deck flange attached to the upper surface of the roof deck of said roof structure in a substantially coaxial position relative to the opening formed therethrough, said deck flange having an axial bore; and (b) an adjustable collar connected to the downwardly facing surface of said flange of said drain body, said adjustable collar being concentrically mounted and axially movable in the axial bore of said deck flange.

7. The combination of claim 3 wherein said adjustable extension means comprises:

(a) a deck flange attached to the upper surface of the roof deck of said roof structure and having an axial bore which is substantially coaxial with the opening formed through said roof structure;

(b) an adjustable collar connected to the downwardly facing surface of the flange of said drain body, said adjustable collar being concentrically disposed in the axial bore of said deck flange; and (c) cooperating elements of an adjustably extensible interconnecting means formed in the axial bore of said deck flange and on the adjustable collar for interconnection thereof and for providing means by which said adjustable collar is movable to variously selectable axially extended positions relative to said deck flange.

8. The combination of claim 7 wherein said deck flange is selectively mountable in a first position so that the portion of said cooperating elements of an adjustably extensible interconnecting means formed in the axial bore of said deck flange is located proximate the roof deck to provide a relatively low adjustment range of said adjustable collar in said deck flange, and in an inverted second position so that the portion of said cooperating elements of an adjustably extensible interconnecting means formed in the axial bore of said deck flange is spaced upwardly from the roof deck to provide a relatively high adjustment range of said adjustable collar in said deck flange.

9. The combination of claim 7 wherein said cooperating elements of an adjustably extensible interconnecting means comprises:

(a) said deck flange having at least an opposed pair of lugs extending radially into the axial bore thereof; and (b) said adjustable collar having a cylindrical body with at least an opposed pair of downwardly opening stair-step notch means formed therein each of which has a plurality of bearing surfaces located at different distances from the lower end of said cylindrical body, said adjustable collar being rotatably movable to bring selected aligned ones of the bearing surfaces of said pair of stair-step notch means into bearing resting engagement with said pair of lugs of said roof deck.

10. The combination of claim 9 wherein said pair of lugs of said deck flange are located proximate one end of the axial bore thereof.

11. The combination of claim 7 wherein said cooperating elements of an adjustably extensible interconnecting means comprises:

(a) said deck flange having threads formed in the axial bore thereof; and (b) said adjustable collar having a cylindrical body with threads formed about the periphery thereof.

12. In a combination of a roof structure with an adjustably extensible roof drain comprising:

(a) a roof structure having means defining an opening and including a roof deck having upper and lower surfaces with roofing materials thereon to provide said roof structure with a top surface;

(b) a drain pipe substantially coaxial with the opening of said roof structure and extending downwardly therefrom;

(c) a one piece drain body in the opening of said roof structure and having an open upper end for receiving water to be drained from the top surface of said roof structure, said drain body having a bottom outlet sealingly connected directly to said drain pipe and having a flange extending substantially laterally therefrom, said flange having a downwardly facing surface and disposed so as to circumscribe the open upper end of said drain body;

(d) a deck flange mounted on the upper surface of the roof deck of said roof structure and having an axial bore which is substantially coaxial with the opening of said roof structure; and (e) an adjustable collar mounted in the axial bore of said deck flange and attached to the downwardly facing surface of said flange of said drain body so that said adjustable collar is coaxial with said drain body, said adjustable collar being axially movable in the axial bore of said deck flange to adjustably position the open upper end of said drain body proximate the top surface of said roof structure.

13. The combination of claim 12 and further comprising:

(a) said roof structure including a membrane with is part of the roofing materials thereof and is located proximate the top surface of said roof structure, said membrane being disposed in overlaying contiguous engagement with said flange of said drain body; and (b) a flashing ring mounted in overlaying contiguous engagement with the portion of said membrane which is on said flange of said drain body, said flashing ring being attached to said drain body to sealingly affix said membrane between said flashing ring and said flange of said drain body.

14. The combination of claim 13 and further comprising a strainer dome on said flashing ring and cooperating therewith to prevent foreign matter from entering into said drain body while allowing a substantially free flow of water which is to be drained from the top surface of said roof structure into said drain body.

15. The combination of claim 12 and further comprising:

(a) a ring-shaped underdeck clamp in bearing engagement with the lower surface of the roof deck in coaxial relationship with the opening of said roof structure; and (b) means for coupling said underdeck clamp to said drain body for fixed clamping thereof to the roof deck of said roof structure.

16. The combination of claim 12 and further comprising:

(a) said deck flange having a cylindrical body through which the axial bore thereof is formed and having an annular ledge mounted on the upper surface of the roof deck of said roof structure, the annular ledge extending laterally from the cylindrical body proximate one end thereof;

(b) said adjustable collar having a cylindrical body which is coaxially disposed in the axial bore of said deck flange; and (c) cooperating elements of an adjustably extensible interconnection means formed in the axial bore of said deck flange and on the cylindrical body of said adjustable collar for interconnection thereof and allowing said adjustable collar to be axially moved in the axial bore of said deck flange.

17. The combination of claim 16 wherein said cooperating elements of an adjustably extensible interconnection means comprises:

(a) said deck flange having at least a pair of diametrically opposed lugs extending radially into the axial bore thereof; and (b) said adjustable collar having at least a pair of diametrically opposed downwardly opening stair-step notch means formed in the cylindrical body thereof each of which has a plurality of bearing surfaces located at different distances from the lower end of the cylindrical body of said adjustable collar, said adjustable collar being rotatably movable in the axial bore of said deck flange to bring selected aligned ones of the bearing surfaces of said pair of stair-step notch means into resting bearing engagement with said pair of lugs of said deck flange.

18. The combination of claim 17 wherein said pair of lugs of said deck flange are located proximate the end of the cylindrical body with is opposite to the end from which the annular ledge extends, said deck flange being mountable on the roof deck in a first position which places said pair of lugs proximate the roof deck to provide a relatively low adjustment range of said adjustable collar in said deck flange and in an inverted position which places said pair of lugs in upwardly spaced relationship with the roof deck to provide a relatively higher adjustment range of said adjustable collar in said deck flange.

19. The combination of claim 16 wherein said cooperating elements of an adjustably extensible interconnection means comprises:

(a) said deck flange having threads in the axial bore thereof; and (b) said adjustable collar having threads formed externally on the cylindrical body thereof.

20. The combination of claim 16 wherein said deck flange is selectably mountable on the upper surface of the roof deck of said roof structure so that the cylindrical body thereof extends downwardly through the roof deck to provide a low adjustment range of said adjustable collar in said deck flange and in a second position so that the cylindrical body is upstanding from the roof deck to provide a relatively higher adjustment range of said adjustable collar in said deck flange.

* * * * *